United States Patent [19]

Irving

[11] Patent Number: 4,927,745

[45] Date of Patent: May 22, 1990

[54] SILVER HALIDE GRAINS AND PROCESS FOR THEIR PREPARATION

[75] Inventor: Mark E. Irving, Rochester, N.Y.

[73] Assignee: Eastman Kodak Company, Rochester, N.Y.

[21] Appl. No.: 369,789

[22] Filed: Jun. 22, 1989

[51] Int. Cl.[5] ..... G03C 1/02

[52] U.S. Cl. ..... 430/567; 430/569

[58] Field of Search ..... 430/567, 569

[56] References Cited

U.S. PATENT DOCUMENTS

| | | | |
|---|---|---|---|
| 4,094,684 | 6/1978 | Maskasky | 430/567 |
| 4,142,900 | 3/1979 | Maskasky | 430/567 |
| 4,639,411 | 1/1987 | Daubendiek et al. | 430/567 |
| 4,672,026 | 6/1987 | Daubendiek | 430/567 |

OTHER PUBLICATIONS

Daubendiek, "AgI Precipitations: Effects of pAg on Crystal Growth (PB), III-23", 1978 International Congress of Photographic Science, Rochester, N.Y.

*Primary Examiner*—Paul R. Michl
*Assistant Examiner*—Thomas R. Neville
*Attorney, Agent, or Firm*—Paul A. Leipold

[57] ABSTRACT

Radiation sensitive silver halide grains are described which comprise at least 90 mole percent silver iodide and which have the morphological configuration of four hexagonal bipyramids, the four bases of which are joined to form a common tetrahedron. A process is described for the preparation of such grains.

12 Claims, 3 Drawing Sheets

SILVER HALIDE GRAINS AND PROCESS FOR THEIR PREPARATION

The present invention relates to radiation sensitive silver halide grains and, in particular, to a process for the preparation of silver halide grains comprising at least 90 mol percent silver iodide wherein the grains have the morphological configuration of four hexagonal bipyramids, the four bases of which are joined to form a common tetrahedron.

The primary morphological forms for silver bromide and silver bromoiodide are varied and are well known in the literature. Such grains range from cubic and octahedral to tabular crystal habits.

Radiation-sensitive silver iodide emulsions, though infrequently employed in photography, are known in the art. Silver halide emulsions which employ grains containing silver iodide as a separate and distinct phase are illustrated in German Patent No. 505,012 issued Aug. 12, 1930; in Steigmann, Photographische Industrie, "Green- and Brown-Developing Emulsions", Vol. 34, pp. 764, 766 and 872, published Jul. 8 and Aug. 5, 1938; in U.S. Pat. Nos. 4,094,684 and 4,142,900; in U.K. Patent Application No. 2,063,499A and in *Research Disclosure*, Vol. 18153, May 1979. The Research Disclosure reference describes silver iodide phosphate photographic emulsions in which silver is coprecipitated with iodide and phosphate. A separate silver iodide phase is not reported.

The crystalline configurations for silver iodide are not as well publicized primarily because silver iodide emulsions are of limited direct utility in many photographic systems. However, crystalline structures of silver iodide have been studied by crystallographers, particularly by those interested in photography. As illustrated by Byerley and Hirsch, "Dispersions of Metastable High Temperature Cubic Silver Iodide", Journal of Photographic Science, Vol. 18, 1970, pp. 53–59, it is generally recognized that silver iodide is capable of existing in three different crystal forms. The most commonly encountered form of silver iodide crystals is the hexagonal wurtzite type, designated $\beta$ phase silver iodide. Silver iodide is also stable at room temperature in its face centered cubic crystalline form, designated $\gamma$ phase silver iodide. A third form of crystalline silver iodide, stable only at temperatures above about 147° C., is the body centered cubic form designated $\alpha$ phase silver iodide. The $\beta$ phase is the most stable form of silver iodide.

James, *The Theory of the Photographic Process*, 4th Ed., Macmillan, 1977, pp. 1 and 2, contains the following summary of the knowledge of the art:

According to the conclusions of Kokmeijer and Van-Hengel, which have been widely accepted, more nearly cubic AgI is precipitated when silver ions are in excess and more nearly hexagonal AgI when iodide ions are in excess. More recent measurements indicate that the presence or absence of gelatin and the rate of addition of the reactants have pronounced effects on the amounts of cubic and hexagonal AgI. Entirely hexagonal material was produced only when gelatin was present and the solutions were added slowly without an excess of either Ag or —I—. No condition was found where only cubic material was observed.

Plate-like silver iodide crystals have been observed. Preparations with an excess of iodide ions, producing hexagonal crystal structures of predominantly $\beta$ phase silver iodide are reported by Ozaki and Hachisu, "Photophoresis and Photoagglomeration of Plate-like Silver Iodide Particles", *Science of Light*, Vol. 19, No. 2, 1970, pp. 59–71 and by Zharkov, Dobroserdova and Panfilova, "Crystallization of Silver Halides in Photographic Emulsions IV, Study by Electron Microscopy of Silver Iodide Emulsions", *Zh. Nauch. Prikl., Fot. Kine.*.Mar.-Apr., 1957, 2 pp. 102–105.

The morphologies of truncated hexagonal pyramidal and hexagonal bipyramidal silver iodide grains are described by Daubendiek in "AgI Precipitations: Effects of pAg on Crystal Growth (PB). III-23", papers from the 1978 International Congress of Photographic Science, Rochester, N.Y., pp. 140–142. The bipyramid silver iodide crystals are described as being useful as precursors for silver chloroiodide, chlorobromoiodide and bromoiodide emulsions in U.S. Pat. Nos. 4,094,684; 4,150,994; 4,184,877; 4,184,878 and 4,414,310.

U.S. Pat. No. 4,094,684 describes composite crystals obtained by deposition of a silver salt epitaxially onto silver iodide grains. Particularly described is the deposition of silver chloride onto silver iodide host grains to obtain multi-faceted silver iodide crystals having a minimum mean diameter of at least 0.1 micron and silver chloride crystals forming epitaxial junctions with the silver iodide crystals. At least one half of the facets of the silver iodide crystals are substantially free of epitaxial silver chloride.

U.S. Pat. No. 4,150,994 describes preparation of silver iodobromide or of silver iodochloride emulsions, utilizing an Ostwald ripening step, which produces silver halide grains of the twinned octahedral or cubic type. This patent describes silver iodide seed grains. However, it neither teaches nor suggests a process for the preparation of silver halide grains, which grains comprise at least 90 mol percent iodide.

U.S. Pat. Nos. 4,184,877 and 4,184,878 are similar to the '994 patent noted above and describe preparation, without use of an Ostwald ripening step, of twinned silver halide crystals formed from silver iodide grains which are predominantly of the hexagonal type. The '878 patent follows the procedure of the '994 patent but also includes the step of chemically sensitizing the silver halide grains.

U.S. Pat. No. 4,414,310 is directed to a process for preparing tabular grain silver bromoiodide emulsions wherein silver and bromide salts are concurrently introduced into a reaction vessel containing an emulsion comprising a dispersing medium and high iodide silver halide grains. Prior to concurrent introduction of silver and bromide salts the mean diameter of the high iodide silver halide grains is limited to less than 0.1 micron and the concentration of iodide is limited to less than $10^{-2}$ mole per liter.

U.S. Pat. No. 4,490,458 describes multicolor photographic elements which contain superimposed emulsion layers for separately recording blue and minus blue light. The elements include at least one emulsion layer comprised of a dispersing medium and silver halide grains, wherein at least 50 percent of the total projected area of the silver halide grains is provided by thin tabular silver iodide grains having a thickness of less than 0.3 micron and an average aspect ratio of greater than 8:1. The multicolor photographic elements show advantages in the minus blue recording emulsion layers directly attributable to the thin tabular silver iodide grains.

None of the above patents or publications describes preparation of silver halide grains which comprise at least 90 mole percent of silver iodide and which have the morphological configuration of four hexagonal bipyramids the four bases of which are joined to form a common tetrahedron. Such grains are desirable for photographic use and also in forming hollow silver halide grains having a predominantly tabular, high iodide morphological configuration. Hollow silver halide grains are disclosed in cofiled U.S. application Ser. No. 07/369,795, of Mark E. Irving and Robert J. Newmiller, entitled "HOLLOW SILVER HALIDE GRAINS AND PROCESS FOR THE PREPARATION THEREOF".

The present invention relates to a process for the preparation of radiation sensitive silver iodide grains which have the morphological configuration of four hexagonal bipyramids the four bases of which are joined to form a common tetrahedron which process comprises the steps of:

(a) forming in a colloid dispersing medium silver halide grains containing at least 90 mol percent iodide by homogeneous nucleation at a pAg value of from about 11.0 to about 5.0 at a temperature between about 30° and 90° C.;

(b) maintaining these conditions until the silver iodide grains are from about 0.005 to about 0.5 μm in diameter;

(c) altering the growth environment of the silver iodide grains to a pAg value of from about 13.5 to about 9.8 at a temperature from about 30° to about 90° C., and, optionally;

(d) removing water soluble salts formed during the precipitation process

Figure 1:
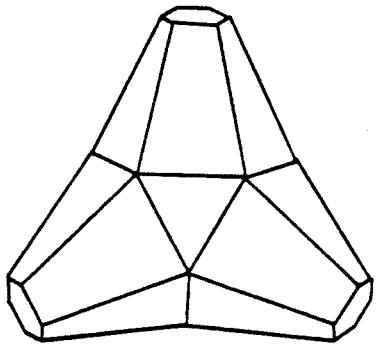
FIG. 1 illustrates a silver halide grain resulting from a control process as described in the Daubendiek 1978 International Congress of Photographic Science paper noted above.

Silver halide grains produced in accordance with this invention comprise at least 90 mol percent silver iodide. The grains consist of a central region from which four hexagonal bipyramids extend at the tetrahedral angle of 109.5°. In one embodiment of the invention the basal planes of the grains are truncated. In another embodiment the crystals are not truncated. The principal differences between these configurations and the FIG. 1 configuration are the relative sizes of the central region and protruding legs and the morphology of the individual legs resulting from the respective processes by which they are manufactured.

The four extensions which protrude at the tetrahedral angle of 109.5° in the grains produced in accordance with this invention are hexagonal bipyramids, whereas the protrusions extending from the grains described in the Daubendiek publication noted above are single hexagonal pyramids.

Where precipitation of silver iodide grains occurs at a pAg value above about 11.0, predominantly truncated hexagonal bipyramid crystalline grains are obtained. Conversely, where precipitation of silver iodide grains occurs at a pAg below about 5.0 nondescript silver iodide grains are obtained.

Where silver iodide grain precipitation is attempted below about 30° C., gelatin coagulation is encountered. When process temperature exceeds about 90° C. severe water loss from the precipitation medium occurs.

A preferred process comprises forming silver halide grains by utilization of a pAg of from about 8.4 to about 5.8, at a temperature between about 30° to about 40° C., with subsequent alteration of growth environment whereby the pAg is raised to between about 13.5 to about 10.9 within a temperature range of from about 35° to about 75° C. This process provides conditions under which silver halide grains comprising at least 90 mol % iodide can be grown to sizes ranging from as little as about 0.01 μm to as large as about 10 μm, where the size is defined as the radius of the smallest circle which could be transcribed around the projected outline of the grain.

The silver iodohalide (at least 90 mol % iodide) grains produced in accordance with the process of this invention are, as noted above, of a complex configuration. Such grains are advantageous in that they present high surface area and therefore comprise favorable surface area to volume ratios. This property is particularly advantageous with respect to both spectral sensitization and development.

The portion of other halides which make up the 10 or less mol percent of halides present in the silver iodohalide grains manufactured in accordance with the process of this invention can be bromide, chloride or a mixture of bromide and chloride. These other halides may be present in the silver iodide crystals without affecting their morphology or they may be deposited epitaxially.

One method of increasing the size of the silver halide crystals formed in steps (a) to (c) is to carry out the precipitation in the presence of a silver halide solvent. It is preferred that the grain growth, or ripening, occur within the reaction vessel during grain formation. Known ripening agents can be used. These include ammonia or an excess of halide ions. It is therefore apparent that the iodide salt solution run into the reaction vessel can itself promote ripening. Other ripening agents can also be employed and can be entirely contained within the dispersing medium in the reaction vessel before silver and halide salt addition, or they can be introduced into the reaction vessel along with one or more of the halide salt, silver salt, or peptizer. In still another variant the ripening agent can be introduced independently during halide and silver salt additions.

Among preferred ripening agents are those containing sulfur. Thiocyanate salts can be used, such as alkali metal, e.g. sodium and potassium, and also ammonium thiocyanate. While any conventional quantity of the thiocyanate salts can be introduced, preferred concentrations are generally from about 0.1 to 20 grams of thiocyanate salt per mole of silver halide. Illustrative prior teachings of employing thiocyanate ripening agents are found in U.S. Pat. Nos. 2,222,264; 2,448,534; 3,320,069; the disclosures of which are herein incorporated by reference. Alternatively, thioether ripening agents, such as those disclosed in U.S. Pat. Nos. 3,271,157; 3,574,628; 3,737,313; and 4,749,646, herein incorporated by reference, can be employed. Also, the solubility of the silver iodide may conveniently be controlled by variation of temperature, the quantity of excess halide ion and the proportion of silver halide solvent in the dispersing medium.

Typical silver halide solvents which are suitable for use in the process of the present invention include both thioethers and thioureas. Thioether solvents include those described in U.S. Pat. Nos. 3,271,157; 3,531,289; 3,574,628; 3,767,413; 4,311,638 and 4,725,560. Useful thiourea solvents include those described in U.S. Pat. Nos. 4,284,717; 4,568,635; 4,695,534; 4,635,535; 4,713,322 and 4,749,646.

Various modifying compounds can be present during grain precipitation. Such compounds can be initially in the reaction vessel or can be added along with one or more of the salts according to conventional procedures. Modifying compounds, such as compounds of copper, thallium, lead, bismuth, cadmium, zinc, middle chalcogens (i.e., sulfur, selenium and tellurium), gold and Group VIII noble metals, can be present during silver halide precipitation. This is illustrated by U.S. Pat. Nos. 1,195,432; 1,951,933; 2,448,060; 2,628,167; 2,950,972; 3,488,709; 3,737,313; 3,772,031 and 4,269,927 and *Research Disclosure*, Vol. 134, Jun. 1975, Item 13452. *Research Disclosure* and its predecessor, *Product Licensing Index*, are publications of Kenneth Mason Publications Limited; Emsworth, Hampshire P010 7DD; United Kingdom. The emulsions can be internally reduction sensitized during precipitation, as illustrated by Moisar et al, Journal of Photographic Science, Vol. 25, 1977, pp. 19–27.

The individual silver and halide salts can be added to the reaction vessel through surface or subsurface delivery tubes, by gravity feed or by delivery apparatus for maintaining control of the rate of delivery and the pH, pBr, and/or pAg of the reaction vessel contents. This is illustrated by U.S. Pat. Nos. 3,821,002 and 3,031,304 and in Claes et al, *Photographische Korresondenz*, Band 102, Number 10, 1967, p. 162. In order to obtain rapid distribution of the reactants within the reaction vessel, specially constructed mixing devices can be employed. These are illustrated by U.S. Pat. Nos. 2,996,287; 3,342,605; 3,415,650; 3,785,777; 4,147,551 and 4,171,224; U.K. patent application No. 2,022,431A; German OLS Nos. 2,555,364 and 2,556,885, and *Research Disclosure*, Volume 166, Feb. 1978, Item 16662.

In forming emulsions a dispersing medium is initially contained in the reaction vessel. In a preferred form the dispersing medium is comprised of an aqueous peptizer suspension. Peptizer concentrations of from 0.2 to about 10 percent by weight, based on the total weight of emulsion components in the reaction vessel, can be employed. It is common practice to maintain the concentration of the peptizer in the reaction vessel in the range of below about 6 percent, based on the total weight, prior to and during silver halide formation and to adjust the emulsion vehicle concentration upwardly for optimum coating characteristics by delayed, supplemental vehicle additions. It is contemplated that the emulsion as initially formed will contain from about 5 to 50 grams of peptizer per mole of silver halide, preferably about 10 to 30 grams of peptizer per mole of silver halide. Additional vehicle can be added later to bring the concentration up to as high as 1000 grams per mole of silver halide. Preferably the concentration of vehicle in the finished emulsion is above 50 grams per mole of silver halide. When coated and dried in forming a photographic element the vehicle preferably forms about 30 to 70 percent by weight of the emulsion layer.

Vehicles (which include both binders and peptizers) can be chosen from among those conventionally employed in silver halide emulsions. Preferred peptizers are hydrophilic colloids, which can be employed alone or in combination with hydrophobic materials. Suitable hydrophilic materials include substances such as proteins, protein derivatives, cellulose derivatives—e.g. cellulose esters, gelatin—e.g., alkali-treated gelatin (cattle bone or hide gelatin) or acid-treated gelatin (pigskin gelatin), gelatin derivatives—e.g., acetylated gelatin, phthalated gelatin and the like, polysaccharides such as dextran, gum arabic, zein, casein, pectin, collagen derivatives, agaragar, arrowroot, albumin and the like as described in U.S. Pat. Nos. 2,614,928; 2,614,929; 2,691,582; 2,614,930; 2,614,931; 2,327,808; 2,448,534; 2,787,545; 2,956,880; 3,061,436; 2,816,027; 3,132,945; 3,138,461; 3,186,846; 2,960,405; 3,436,220; 3,486,896; 2,992,213; 3,157,506; 3,184,312; 3,539,353; 3,227,571; 3,532,502; 3,551,151 and 4,018,609.

Other materials commonly employed in combination with hydrophilic colloid peptizers as vehicles (including vehicle extenders—e.g., materials in the form of latices) include synthetic polymeric peptizers, carriers and/or binders such as poly(vinyl lactams) acrylamide polymers, polyvinyl alcohol and its derivatives, polyvinyl acetals, polymers of alkyl and sulfoalkyl acrylates and methacrylates, hydrolyzed polyvinyl acetates, polyamides, polyvinyl pyridine, acrylic acid polymers, maleic anhydride copolymers, polyalkylene oxides, methacrylamide copolymers, polyvinyl oxazolidinones, maleic acid copolymers, vinylamine copolymers, methacrylic acid copolymers, acryloyloxyalkylsulfonic acid copolymers, sulfoalkylacrylamide copolymers, polyalkyleneimine, copolymers, polyamines, N,N-dialkyliminoalkyl acrylates, vinyl imidazole copolymers, vinyl sulfide copolymers, halogenated styrene polymers, amineacrylamide polymers, polypeptides and the like as described in U.S. Pat. Nos. 3,679,425; 3,706,564; 3,813,251; 2,253,078; 2,276,322; 2,276,323; 2,281,703; 2,311,058; 2,414,207; 2,484,456; 2,541,474; 2,632,704; 3,425,836; 3,415,653; 3,615,624; 3,488,708; 3,392,025; 3,511,818; 3,681,079; 3,721,565; 3,852,073; 3,861,918; 3,925,083; 3,879,205; 3,142,568; 3,062,674 and 3,220,844.

These additional materials need not be present in the reaction vessel during silver halide precipitation, but rather are conventionally added to the emulsion prior to coating. The vehicle materials, including particularly the hydrophilic colloids, as well as the hydrophobic materials useful in combination therewith can be employed not only in the emulsion layers of the photographic elements of this invention, but also in other layers, such as overcoat layers, interlayers and layers positioned beneath the emulsion layers.

The emulsions are preferably washed to remove soluble salts. The soluble salts can be removed by decantation, filtration, and/or chill setting and leaching, as illustrated by U.S. Pat. Nos. 2,316,845 and 3,396,027, by coagulation washing, as illustrated by U.S. Pat. Nos. 2,618,556; 2,614,928; 2,565,418; 3,241,969 and 2,489,341, by centrifugation and decantation of a coagulated emulsion, as illustrated by U.S. Pat. Nos. 2,463,794; 3,707,378; 2,996,287 and 3,498,454, by employing hydrocyclones alone or in combination with centrifuges, as illustrated by U.K. Patent Nos. 1,336,692; 1,356,573 and by Ushomirskii et al Soviet Chemical Industry, Vol. 6, No. 3, 1974, pp. 181–185. The emulsions, with or without sensitizers, can be dried and stored prior to use as illustrated by *Research Disclosure*, Vol. 101, Sept.

1972, Item 10152. Washing is particularly advantageous after the completion of precipitation.

The silver halide emulsions employed in this invention can be sensitized by conventional techniques. A preferred chemical sensitization technique is to deposit a silver salt epitaxially onto the grains. The epitaxial deposition of silver chloride onto silver iodide host grains is taught by U.S. Pat. Nos. 4,094,684 and 4,142,900, and the analogous deposition of silver bromide onto silver iodide host grains is taught by U.K. Patent application 2,053,499A, each cited above and here incorporated by reference.

The sensitizing silver salt that is deposited onto the grains at selected sites can be chosen from among any silver salt capable of being epitaxially grown on a silver halide grain and heretofore known to be useful in photography. The anion content of the silver salt and the silver iodide are sufficiently different to permit detection of such differences in the respective crystal structures. It is specifically contemplated to choose the silver salts from among those heretofore known to be useful in forming shells for core-shell silver halide emulsions. In addition to all the known photographically useful silver halides, the silver salts can include other silver salts known to be capable of precipitating onto silver halide grains, such as silver thiocyanate, silver cyanide, silver carbonate, silver ferricyanide, silver arsenate or arsenite, and silver chromate. Silver chloride is a specifically preferred sensitizer. Depending upon the silver salt chosen and the intended application, the silver salt can usefully be deposited in the presence of any of the modifying compounds described above, or with sensitizing dyes described below. Some iodide from the host grains may enter the silver salt epitaxy. It is also contemplated that the host grains can contain anions other than iodide up to their solubility limit in silver iodide, and, as employed herein, the term "silver iodide grains" is intended to include such host grains.

Conventional chemical sensitization can be undertaken prior to controlled site epitaxial deposition of silver salt on the host silver iodide grain or as a following step. When silver chloride and/or silver thiocyanate is deposited, a large increase in sensitivity is realized merely by selective site deposition of the silver salt. Thus, further chemical sensitization steps of a conventional type need not be undertaken to obtain photographic speed. On the other hand, an additional increment in speed can generally be obtained when further chemical sensitization is undertaken, and it is a distinct advantage that neither elevated temperature nor extended holding times are required in finishing the emulsion. The quantity of sensitizers can be reduced, if desired, where (1) epitaxial deposition itself improves sensitivity or (2) sensitization is directed to epitaxial deposition sites.

Any conventional technique for chemical sensitization following controlled site epitaxial deposition can be employed. In general, chemical sensitization should be undertaken based on the composition of the silver salt deposited rather than the composition of the host grains since chemical sensitization is believed to occur primarily at the silver salt deposition sites or perhaps immediately adjacent thereto. Conventional techniques for achieving noble metal (e.g., gold), middle chalcogen (e.g., sulfur, selenium, and/or tellurium), or reduction sensitization as well as combinations thereof are disclosed in *Research Disclosure*, Item 17643, Paragraph III, cited above.

In one preferred form, chemical sensitization is undertaken after spectral sensitization. Similar results have also been achieved in some instances by introducing other adsorbable materials, such as finish modifiers, into the emulsion prior to chemical sensitization. Independent of the prior incorporation of adsorbable materials, it is preferred to employ thiocyanates during chemical sensitization in concentrations of from about $2\times10^{-3}$ to 2 mole percent, based on silver, as taught by Damschroder U.S. Pat. No. 2,462,361. Other ripening agents can be used during chemical sensitization. Still a third approach, capable of being practiced independently of, but compatible with, the two approaches described above, is to deposit silver salts epitaxially as is taught in U.S. Pat. No. 4,435,501, herein incorporated by reference.

Silver iodide emulsions record blue light and need not be spectrally sensitized in the blue portion of the spectrum. However, it is advantageous to extend the blue sensitivity of silver iodide through the use sensitizing dyes. This is particularly true for high surface area to volume grains such as those of this invention. Silver bromide and silver bromoiodide emulsions can be employed to record blue light without incorporating blue sensitizers, although their absorption efficiency is much higher when blue sensitizers are present. The silver halide emulsions, regardless of composition, intended to record minus blue light are spectrally sensitized to red or green light by the use of spectral sensitizing dyes.

The silver halide emulsions of this invention can be spectrally sensitized with dyes from a variety of classes, including the polymethine dye class, which classes include the cyanines, merocyanines, complex cyanines and merocyanines (i.e., tri-, tetra-, and poly-nuclear cyanines and merocyanines), oxonols, hemioxonols, styryls, merostyryls, and streptocyanines.

The cyanine spectral sensitizing dyes include, joined by a methine linkage, two basic heterocyclic nuclei, such as those derived from quinolinium, pyridinium, isoquinolinium, 3H-indolium, benz[e]indolium, oxazolinium, oxazolinium, thiazolinium, selenazolium, selenazolinium, imidazolium, imidazolinium, benzoxazolium, benzothiazolium, benzoselenazolium, benzimidazolium, naphthoxazolium, naphthothiazolium, naphthoselenazolium, dihydronaphthothiazolium, pyrylium and imidazopyrazinium quaternary salts.

The merocyanine spectral sensitizing dyes include joined by a double bond or a methine linkage, a basic heterocyclic nucleus of the cyanine dye type and an acidic nucleus, such as can be derived from barbituric acid, 2-thiobarbituric acid, rhodanine, hydantoin, 2-thiohydantoin, 4-thiohydantoin, 2-pyrazolin-5-one, 2-isoxazolin-5-one, indan-1,3-dione, cyclohexane-1,3-dione, 1,3-dioxane-1,6-dione, pyrazolin-3,5-dione, pentane-2,4-dione, alkylsulfonylacetonitrile, malononitrile, isoquinolin-4-one, and chroman-2,4-dione.

One or more spectral sensitizing dyes may be used. Dyes with sensitizing maxima at wavelengths throughout the visible spectrum and with a great variety of spectral sensitivity curve shapes are known. The choice and relative proportions of dyes depends upon the region of the spectrum to which sensitivity is desired and upon the shape of the spectral sensitivity curve desired.

Dyes with overlapping spectral sensitivity curves will often yield in combination a curve in which the sensitivity at each wavelength in the area of overlap is approximately equal to the sum of the sensitivities of the individual dyes. Thus, it is possible to use combinations of dyes with different maxima to achieve a spectral sensitivity curve with a maximum intermediate to the sensitizing maxima of the individual dyes.

Combinations of spectral sensitizing dyes can be used which result in supersensitization—that is, spectral sensitization that is greater in some spectral region than that from any concentration of one of the dyes alone or that which would result from the additive effect of the dyes. Supersensitization can be achieved with selected combinations of spectral sensitizing dyes and other addenda, such as stabilizers and antifoggants, development accelerators or inhibitors, coating aids, brighteners and antistatic agents. Any one of several mechanisms as well as compounds which can be responsible for supersensitization are discussed by Gilman, "Review of the Mechanisms of Supersensitization", *Photographic Science and Engineering*, Vol. 18, 1974, pp. 418–430.

Preferred spectral sensitizing dyes are described in greater detail in U.S. Pat. No. 4,490,458, the disclosure of which is hereby incorporated by reference.

Spectral sensitization can be undertaken at any stage of emulsion preparation heretofore known to be useful. Most commonly spectral sensitization is undertaken in the art subsequent to the completion of chemical sensitization. However, it is specifically recognized that spectral sensitization can be undertaken alternatively concurrently with chemical sensitization, can entirely precede chemical sensitization, and can even commence prior to the completion of silver halide grain precipitation, as taught by U.S. Pat. Nos. 3,628,960 and Locker et al U.S. Pat. No. 4,225,666. As taught by Locker et al, it is specifically contemplated to distribute introduction of the spectral sensitizing dye into the emulsion so that a portion of the spectral sensitizing dye is present prior to chemical sensitization and a remaining portion is introduced after chemical sensitization. Unlike Locker et al, it is specifically contemplated that the spectral sensitizing dye can be added during the precipitation. Sensitization can be enhanced by pAg adjustment, including variation in pAg which completes one or more cycles, during chemical and/or spectral sensitization. A specific example of pAg adjustment is provided by *Research Disclosure*, Vol. 181, May 1979, Item 18155.

In addition to the radiation-sensitive emulsions described above the photographic elements described herein can include a variety of features which are conventional in multicolor photographic elements and therefore require no detailed description. For example, the photographic elements can employ conventional features, such as disclosed in *Research Disclosure*, Item 17643, cited above and here incorporated by reference. Optical brighteners can be introduced, as disclosed by Paragraph V. Antifoggants and sensitizers can be incorporated as disclosed by Paragraph VI. Absorbing and scattering materials can be employed in the emulsions of the invention and in separate layers of the photographic elements, as described in Paragraph VIII. Hardeners can be incorporated, as disclosed in Paragraph X. Coating aids, as described in Paragraph XI, and plasticizers and lubricants, as described in Paragraph XII, can be present. Antistatic layers, as described in Paragraph XIII, can be present. Methods of addition of addenda are described in Paragraph XIV. Matting agents can be incorporated, as described in Paragraph XVI. Developing agents and development modifiers can, if desired, be incorporated, as described in Paragraphs XX and XXI. Silver halide emulsion layers as well as interlayers, overcoats, and subbing layers, if any, present in the photographic elements can be coated and dried as described in Paragraph XV.

The layers of the photographic elements can be coated on a variety of supports. Typical photographic supports include polymeric film, wood fiber—e.g., paper, metallic sheet and foil, glass and ceramic supporting elements provided with one or more subbing layers to enhance the adhesive, antistatic, dimentional, abrasive, hardness, frictional, antihalation and/or other properties of the support surface. Typical of useful paper and polymeric film supports are those disclosed in *Research Disclosure*, Item 17643, cited above, Paragraph XVII.

The photographic elements can be used to form dye images therein through the selective destruction or formation of dyes. The photographic elements can be used to form dye images by employing developers containing dye image formers, such as color couplers, as illustrated by U.K. Patent Nos. 478,984 and 886,723; by U.S. Pat. Nos. 3,113,864, 3,002,836; 2,271,238; 2,362,598; 2,950,970; 2,592,243; 2,343,703; 2,376,380; 2,369,489; 886,723 2,899,306; 3,152,896; 2,115,394; 2,252,718; 2,108,602 and 3,547,650. In this form the developer contains a color-developing agent (e.g., a primary aromatic amine) which in its oxidized form is capable of reacting with the coupler (coupling) to form the image dye.

The dye-forming couplers can be incorporated in the photographic elements, as illustrated by Schneider et al, *Die Chemie*, Vol. 57, 1944, p. 113, and by U.S. Pat. Nos. 2,304,940; 2,269,158; 2,322,027; 2,376,679; 2,801,171; 3,748,141; 2,772,163; 2,835,579; 2,533,514; 2,353,754; 3,409,435 and also *Research Disclosure*, Vol. 159, Jul. 1977, Item 15930. The dye-forming couplers can be incorporated in different amounts to achieve differing photographic effects. For example, U.K. Patent No. 923,045 and U.S. Pat. No. 3,843,369 teach limiting the concentration of coupler in relation to the silver coverage to less than normally employed amounts in faster and intermediate speed emulsion layers.

The dye-forming couplers are commonly chosen to form subtractive primary (i.e., yellow, magenta and cyan) image dyes and are nondiffusible, colorless couplers, such as two and four equivalent couplers of the open chain ketomethylene, pyrazolone, pyrazolotriazole, pyrazolobenzimidazole, phenol and naphthol type hydrophobically ballasted for incorporation in high-boiling organic (coupler) solvents.

The dye-forming couplers upon coupling can release photographically useful fragments, such as development inhibitors or accelerators, bleach accelerators, developing agents, silver halide solvents, toners, hardeners, fogging agents, antifoggants, competing couplers, chemical or spectral sensitizers and desensitizers. Development inhibitor-releasing (DIR) couplers are illustrated by various patents, including U.S. Pat. Nos. 3,148,062; 3,227,554; 3,733,201; 3,265,506; and 3,869,291. Dye-forming couplers and non dye-forming compounds which upon coupling release a variety of photographically useful groups are described in U.S. Pat. No. 4,248,962. DIR compounds which do not form dye upon reaction with oxidized color-developing agents can be employed, as illustrated by German OLS No. 2,529,350 and U.S. Pat. Nos. 3,928,041; 3,958,993 and 3,961,959. DIR compounds which oxidatively cleave can be employed as illustrated by U.S. Pat. Nos. 3,379,529; 3,043,690; 3,364,022; 3,297,445 and 3,287,129.

Silver halide emulsions which are relatively light insensitive, such as Lippmann emulsions, have been utilized as interlayers and overcoat layers to prevent or to control the migration of development inhibitor fragments as described in U.S. Pat. No. 3,892,572.

The photographic elements can incorporate colored dye-forming couplers, such as those employed to form integral masks for negative color images, as illustrated by U.S. Pat. Nos. 2,449,966; 2,521,908; 3,034,892; 3,476,563; 3,519,429; 2,543,691; 3,028,238; 3,061,432 and U.K. Patent No. 1,035,959.

The invention can be better appreciated by reference to the following discussion of distinctive features exhibited by photographic elements employing the silver iodide grains of this invention.

a. Blue light absorbing capabilities

Multicolor photographic elements employing grains prepared in accordance with this invention use at least one emulsion layer containing silver iodide grains to record imagewise exposures to the blue portion of the visible spectrum. Since silver iodide possesses a very high level of absorption of blue light in the spectral region of less than about 430 nanometers, in one application of this invention the silver iodide grains can be relied upon to absorb blue light of 430 nanometers or less in wavelength without the use of a blue spectral sensitizing dye.

Although silver iodide grain emulsions can be used to record blue light exposures without the use of spectral sensitizing dyes, it is appreciated that the native blue absorption of silver iodide is not high over the entire blue region of the spectrum. To achieve a photographic response over the entire blue region of the spectrum it is specifically contemplated to employ in combination with such emulsions one or more blue sensitizing dyes. The dye preferably exhibits an absorption peak of a wavelength longer than 430 nanometers so that the absorption of the silver iodide forming the grains and the blue sensitizing dye together extend over a larger wavelength range of the blue spectrum.

b. Capabilities related to epitaxy

There are advantages to be realized by epitaxially depositing silver chloride onto the silver halide host grains. Once the silver chloride is epitaxially deposited, however, it can be altered in halide content by substituting less soluble halide ions in the silver chloride crystal lattice. Using a conventional halide conversion process bromide and/or halide ions can be introduced into the original silver chloride crystal lattice. Halide conversion can be achieved merely by bringing the emulsion comprised of silver halide host grains bearing silver chloride epitaxy into contact with an aqueous solution of bromide and/or iodide salts. An advantage is achieved in extending the halide compositions available for use while retaining the advantages of silver chloride epitaxial deposition. Further advantages and features of this form of the invention can be appreciated by reference to U.S. Pat. No. 4,142,900, here incorporated by reference.

When the silver salt epitaxy is much more readily developed than the host grains, it is possible to control whether the silver salt epitaxy alone or the entire composite grain develops merely by controlling the choice of developing agents and the conditions of development. With vigorous developing agents, such as hydroquinone, catechol, halohydroquinone, N-methylaminophenol sulfate, 3-pyrazolidinone, and mixtures thereof, complete development of the composite silver halide grains can be achieved. U.S. Pat. No. 4,094,684, cited above and here incorporated by reference, illustrates that under certain mild development conditions it is possible to selectively develop silver chloride epitaxy while not developing silver iodide host grains. Development can be specifically optimized for maximum silver development or for selective development of epitaxy, which can result in reduced graininess of the photographic image. Further, the degree of silver iodide development can control the release of iodide ions, which can be used to inhibit development.

c. Capabilities imparted by iodide ion release

In a specific application of this invention a multicolor photographic element can be constructed incorporating a uniform distribution of a redox catalyst in addition to at least one layer containing silver iodide grains. When the silver iodide grains are imagewise developed, iodide ion is released which locally poisons the redox catalyst. Thereafter a redox reaction can be catalyzed by the remaining unpoisoned catalyst. U.S. Pat. No. 4,089,685, here incorporated by reference, specifically illustrates a useful redox system in which a peroxide oxidizing agent and a dye-image-generating reducing agent, such as a color developing agent or redox dye-releaser, react imagewise at available, unpoisoned catalyst sites within a photographic element. Maskasky U.S. Pat. No. 4,158,565, here incorporated by reference, discloses the use of silver iodide host grains bearing a silver chloride epitaxy in such a redox amplification system.

While the invention has been described above in terms of a silver iodide emulsion layer being employed as a blue recording emulsion layer, it is appreciated that this emulsion layer can be employed in other ways and still perform its desired function of reducing blue light exposure of the minus blue recording emulsion layers. For example, the silver iodide grain emulsions can be employed as an additional layer in a multicolor photographic element and not be relied upon to record light exposures. If a separate blue recording emulsion layer is present in the multicolor photographic element, the silver iodide emulsion layer can merely supplement the blue recording capability of this separate emulsion layer or the silver iodide emulsion layer can simply not produce any useful record of light exposure. The latter can occur if the silver iodide emulsion layer is not sufficiently sensitized or is desensitized. If the silver iodide emulsion layer lacks access to dye image providing material—e.g., no dye-forming coupler is present in this layer and this layer is separated from any other dye-forming coupler layer by oxidized developing agent scavenger, the result is realized of producing no visible record of light exposure even though the emulsion produces an otherwise useful latent image. When the silver iodide emulsion layer is not relied upon to record exposing radiation, it remains useful in absorbing blue light that would otherwise contaminate the minus blue record of the multicolor photographic element. In this instance the silver iodide emulsion layer should lie between at least one of the minus blue recording layers and the source of exposing radiation. In this application the silver iodide emulsion layer can be an advantageous alternative to conventional yellow filter layers.

The preparation of high iodide silver halide grains having the morphological configuration of a four hexagonal bipyramids wherein the four bases are joined to form a common tetrahedron is illustrated as follows wherein Steps (a) and (b) are completed together and are then followed by Steps (c) and, optionally, (d):

(a) To an 8 liter vessel was added 30 g gelatin and 300 ml distilled water. The resulting solution was adjusted to a temperature of 35° C. and the pAg was adjusted to 6.5 using 0.01M $AgNO_3$; 3000 ml of a 1.0N KI solution and 3000 ml of a 1.0N $AgNO_3$ solution were prepared. Addition of these solutions to the vessel were then begun using a double-jet technique with pAg control by an addition rate of 1 ml/min for 5 minutes.

After this, 20 g of gelatin was dissolved in 500 ml of distilled water and this solution was added to the vessel.

(b) Growth of the crystals was continued by utilizing an accelerated double jet flow scheme as outlined below:

| Segment time | Start flowrate | End flowrate |
|---|---|---|
| 20 min | 1.0 ml/min | 1.0 ml/min |
| +120 min | 1.0 ml/min | 5.0 ml/min |
| +120 min | 5.0 ml/min | 9.0 ml/min |

After the reactant solutions were added, the emulsion was washed and then concentrated to 1.19 Kg/mol Ag. The emulsion pAg was 8.1 at 40° C.

(c) To an 18 liter vessel was added:

100 g gelatin 8.3 g potassium iodide 4.76 g of emulsion from Step (b) above 5,000 ml distilled water The resulting solution was adjusted to a temperture to 70° C.; the pAg was 11.5.

2500 ml of a 2.0N KI solution and 8800 ml of a 0.5N $AgNO_3$ solution were prepared. These solutions were added to the vessel via a double-jet, pAg controlled fashion starting at 50 ml/min of silver reactant. A growth profile was also used here as follows:

| Segment Time | Ag start | Ag end | salt start | salt end |
|---|---|---|---|---|
| 5 min | 50 ml/min | 50 ml/min | 12.5 ml/min | 12.5 ml/min |
| 83 min | 50 ml/min | 140 ml/min | 12.5 ml/min | 35 ml/min |

(d) After the reactants were added the emulsion was washed, concentrated and stored at a pAg of 9.6 at 40° C.

Figure 2:
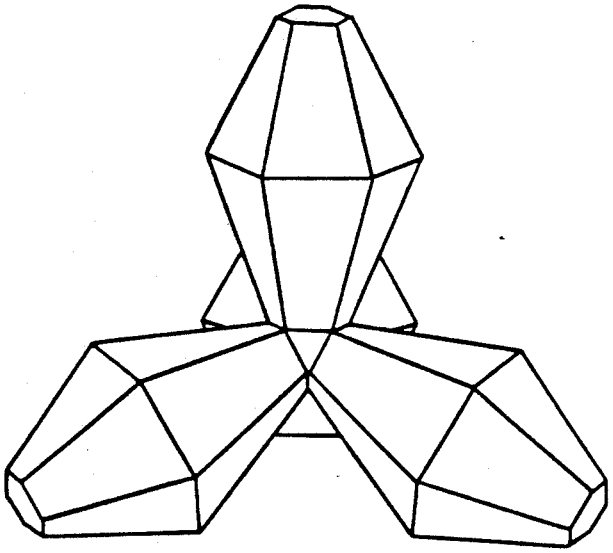
FIG. 2 illustrates a silver iodide grain produced by the process of this invention, which grain comprise four truncated hexagonal bipyramids, the four bases of which are joined to form a common tetrahedron.
Figure 3:
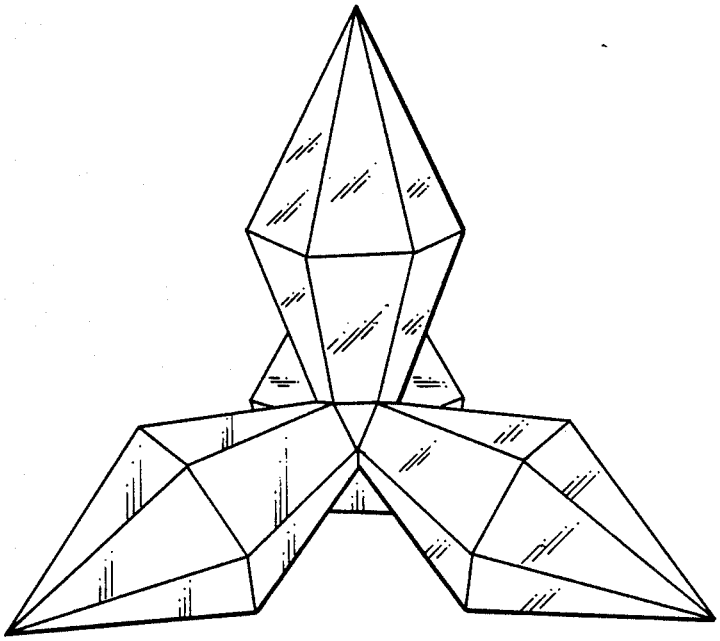
FIG. 3 illustrates a silver iodide grain produced by the process of this invention, which comprises four hexagonal bipyramids which are not truncated, the bases of each leg being joined to form a common tetrahedron.

The morphological configuration of the grains obtained comprise four truncated hexagonal bipyramids, the four bases of which being joined to form a common tetrahedron as illustrated in FIG. 2.

This invention has been described in detail with particular reference to preferred embodiments thereof, but it will be understood that variations and modifications can be affected within the spirit and scope of the invention.

What is claimed is:

1. A process for the preparation of radiation sensitive silver halide grains which have the morphological configuration of four hexagonal bipyramids, the four bases of which are joined to form a common tetrahedron which process comprises the steps of:

(a) forming in a colloid dispersing medium silver halide grains containing at least 90 mol % iodide by homogeneous nucleation of silver iodide grains at a pAg of from about 11.0 to about 5.0 at a temperature between about 30° and 90° C.;

(b) maintaining these conditions until the silver iodide grains are from about 0.005 to about 0.5 μm in diameter;

(c) altering the growth environment of the silver iodide grains to a pAg of from about 13.5 to about 9.8 at a temperature from about 30° to about 90° C., and optionally;

(d) removing water soluble salts formed during the precipitation.

2. The process of claim 1 wherein nucleation of silver iodide grains occurs at a pAg of from about 8.4 to about 5.8.

3. The process of claim 2 which is conducted at a temperature between about 30° to about 40° C.

4. The process of claim 3 wherein step (c) is conducted at a pAg between about 13.5 to about 10.9 within a temperature of from about 35° to about 75° C.

5. The process of claim 1 wherein the silver halide grains are monodisperse.

6. The process of claim 1 wherein steps (a) to (c) are carried out in the presence of a silver halide solvent.

7. The process of claim 6 wherein the silver halide solvent is a thioether or a thiourea compound.

8. The process of claim 1 wherein the silver halide grains are from about 0.05 to about 10 microns in size.

9. Silver halide grains comprising at least 90 mole % iodide prepared as described in claim 1.

10. Silver halide grains comprising at least 90 mole % iodide which have the morphological configuration of four hexagonal bipyramids, the four bases of which are joined to form a common tetrahedron.

11. Silver halide grains of claim 10 wherein the legs of the four hexagonal bipyramids are truncated.

12. A light sensitive silver halide emulsion comprising silver halide grains of any one of claims 10 or 11.

* * * * *